US011668306B2

(12) United States Patent
Su et al.

(10) Patent No.: US 11,668,306 B2
(45) Date of Patent: Jun. 6, 2023

(54) COUPLING BETWEEN CRANKSHAFT AND ORBITING SCROLL PLATE

(71) Applicant: Emerson Climate Technologies GmbH, Berlin (DE)

(72) Inventors: Xiaogeng Su, Mechelen (BE); Jesús Ángel Nohales Herraiz, Aachen (DE); Linus Dellweg, Aachen (DE); Laurence Grosjean, Mortier (BE); Vinod Arun Kokate, Pune (IN)

(73) Assignee: Emerson Climate Technologies GmbH, Berlin (DE)

( * ) Notice: Subject to any disclaimer, the term of this patent is extended or adjusted under 35 U.S.C. 154(b) by 19 days.

(21) Appl. No.: 17/244,407

(22) Filed: Apr. 29, 2021

(65) Prior Publication Data

US 2021/0340983 A1 Nov. 4, 2021

(30) Foreign Application Priority Data

Apr. 30, 2020 (EP) ..... 20172342

(51) Int. Cl.
*F04C 29/00* (2006.01)
*F04C 18/02* (2006.01)

(52) U.S. Cl.
CPC ..... *F04C 29/0057* (2013.01); *F04C 18/0215* (2013.01); *F04C 29/0071* (2013.01); *F04C 2240/60* (2013.01); *F04C 2240/605* (2013.01)

(58) Field of Classification Search
CPC ..... F04C 29/005; F04C 29/0057; F04C 29/0071; F04C 29/0078;
(Continued)

(56) References Cited

U.S. PATENT DOCUMENTS 5,222,881 A * 6/1993 Sano ..... F16D 3/20 464/106
5,328,342 A * 7/1994 Ishii ..... F04C 29/0057 418/57

(Continued)

FOREIGN PATENT DOCUMENTS

JP 04072484 A * 3/1992
JP H10281083 A * 10/1998

(Continued)

OTHER PUBLICATIONS

Extended European Search Report regarding Application No. 20172342.6 dated Aug. 12, 2020.

*Primary Examiner* — Mark A Laurenzi
*Assistant Examiner* — Xiaoting Hu
(74) *Attorney, Agent, or Firm* — Harness, Dickey & Pierce, P.L.C.

(57) ABSTRACT

A system for use in a scroll compressor is described. The system comprises a crankshaft with a first end portion, wherein the crankshaft defines an axis of rotation, and slider block having a recess, wherein the first end portion of the crankshaft and the recess in the slider block are configured for connecting the slider block to the first end portion. The first end portion of the crankshaft comprises a first flat contact surface portion and the recess of the slider block comprises a second flat contact surface portion, the first and second contact surface portions facing each other when the first end portion is connected to the slider block. The system is characterized in that at least one of the flat contact surface portions comprises a slit beneath the at least one flat contact surface portion. Further, a corresponding slider block and a corresponding crankshaft are described.

8 Claims, 7 Drawing Sheets

Figure 1:
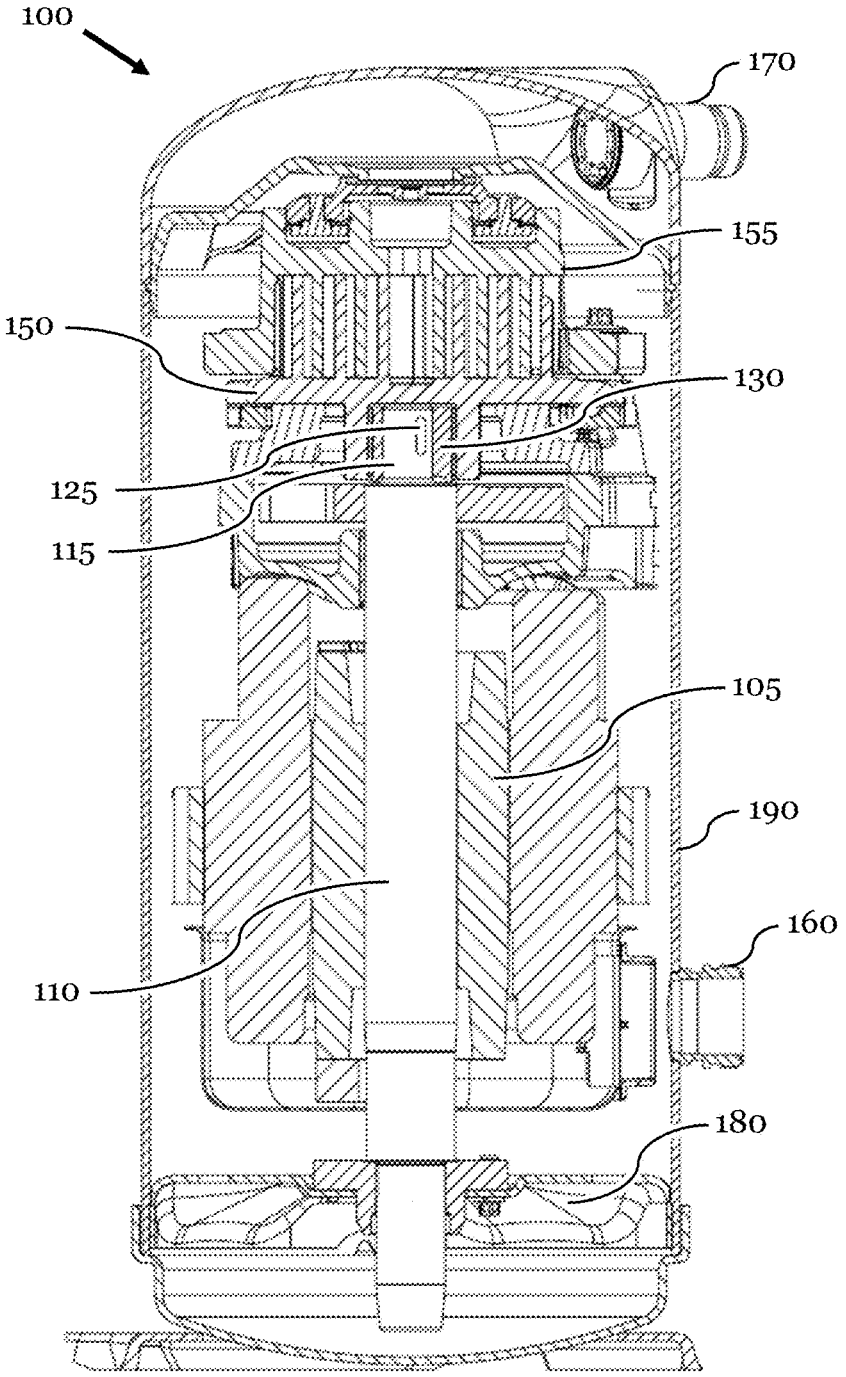

(58) Field of Classification Search
CPC .... F04C 18/0215–0292; F04C 2240/60; F04C 2240/601; F04C 2240/605
See application file for complete search history.

(56) References Cited

U.S. PATENT DOCUMENTS

| | | | | | |
|---|---|---|---|---|---|
| 5,439,360 | A * | 8/1995 | Barito | F16D 3/16 | 464/106 |
| 5,496,158 | A | 3/1996 | Barito et al. | | |
| 7,476,092 | B1 | 1/2009 | Bush | | |
| 2012/0258003 | A1* | 10/2012 | Hahn | F04C 29/0071 | 418/55.2 |
| 2014/0147324 | A1* | 5/2014 | Utpat | F04C 29/0057 | 418/55.1 |
| 2014/0205484 | A1* | 7/2014 | Ignatiev | F04C 18/0215 | 418/55.3 |

FOREIGN PATENT DOCUMENTS

| | | | | |
|---|---|---|---|---|
| JP | 2009275582 | A * | 11/2009 | |
| WO | WO-2015049745 | A1 * | 4/2015 | F04C 18/0215 |

* cited by examiner

COUPLING BETWEEN CRANKSHAFT AND ORBITING SCROLL PLATE

CROSS-REFERENCE TO RELATED APPLICATIONS

This application claims priority to European Patent Application No. 20172342.6 filed on Apr. 30, 2020, the entire disclosure of which is incorporated herein by reference.

FIELD

The current application relates to a crankshaft and slider block for use in a compressor, in particular a scroll compressor, wherein such compressor could be used, for example, in refrigeration systems.

BACKGROUND

A compressor is an apparatus, which reduces the volume of a fluid by increasing the pressure of the fluid. In most common applications, the fluid is a gas.

The compressors are used, for example, in refrigeration systems. In a common refrigeration system, a refrigerant is circulated through a refrigeration cycle. Upon circulation, the refrigerant undergoes changes in thermodynamic properties in different parts of the refrigeration system and transports heat from one part of the refrigeration system to another part of the refrigeration system. The refrigerant is a fluid, i.e. a liquid or a vapour or gas. Examples of refrigerants may be artificial refrigerants like fluorocarbons. However, in recent applications, the use of carbon dioxide, $CO_2$, which is a non-artificial refrigerant, has become more and more important, because it is non-hazardous to the environment.

In the compressor, a motor drives the compression process. Usually, electric motors are used. The motor provides a force, which is provided to a means for compressing, in which the fluid is compressed. In a scroll compressor, the means for compressing is formed by scroll plates. The force, which is provided by the motor, is applied to the means for compressing by ease of a crankshaft.

In case of a scroll compressor, the scroll compressor comprises a stationary scroll plate and an orbiting scroll plate. The force provided by the motor is applied to the orbiting scroll plate. In order to achieve this, one portion of the crankshaft is coupled to the motor and another portion, preferably an end portion, is coupled to the orbiting scroll plate. For example, the orbiting scroll plate may comprise a recess, in which a slider block is located. The slider block is configured to receive a portion of the crankshaft. For example, the crankshaft may comprise an end portion and the slider block may comprise a recess, wherein the end portion of the crankshaft fits at least partially into the recess of the slider block. The end portion of the crankshaft may be a protruding element, such as a pin.

During operation, the force applied by the motor causes a motion of the crankshaft. The motion may be a rotational motion of the crankshaft around an axis of rotation. The axis of rotation may be a longitudinal axis, which is defined by the crankshaft. For example, in case of a cylindrical crankshaft, the axis of rotation may be the cylinder axis of the cylindrical crankshaft.

The motion of the crankshaft is transferred to the orbiting scroll plate, for example by ease of the slider block. The crankshaft is form-fittingly coupled to the slider block. In an example, the crankshaft may comprise a first end portion, such as a pin, which is in form-fitting contact to the slider block, for example by at least partially extending into a recess of the slider block. The first end portion may comprise a first flat contact surface portion and the recess may comprise a corresponding second flat contact surface portion. When the first end portion is coupled to the recess, the first and second flat contact surface portions may engage each other and form contacting surfaces. A flat contact surface portion in the sense of the current invention refers to a surface portion, which is flat when looked at in a plane of a cross-section oriented perpendicular to the axis of rotation defined by the crankshaft. In a particular example, the first end portion may have a substantially circular cross-section, wherein a portion of the circular cross-section may be flattened, thereby, forming a cross-section in the form of a "D". In other examples, the cross-section may have other forms, for example the form of a rectangle.

When the crankshaft performs a rotational motion, the motion is transferred to the slider block. Since the crankshaft performs a rotational motion around the first axis of rotation, the slider block also performs a rotational motion. Preferably, the slider block performs a combination of an orbiting motion and a rotational motion, for example when a center point of the slider block in a plane perpendicular to the axis of rotation has an offset relative to the axis of rotation when the slider block is assembled onto the first end portion of the crankshaft. This may be achieved when a center point of the first end portion of the crankshaft has an offset relative to the axis of rotation or when the slider block has a bore, which is offset to a symmetry axis of the slider block, wherein the symmetry axis of the slider block is parallel to the axis of rotation of the crankshaft in an assembled state.

The slider block may be located in a recess in the orbiting scroll plate. In said recess, the slider block may rotate freely. This may be achieved by a cylindrical shell surface of the slider block. However, the orbiting motion caused by the offset is transferred from the slider block to the orbiting scroll plate and causes an orbiting motion of the scroll plate relatively to the stationary scroll plate.

In a refrigeration system, the refrigerant is compressed to a high pressure. The moving components within the compressor, for example the motor, the crankshaft, and the slider block, move and work against the high pressure and are therefore subject to substantial wear. This is an issue, particularly for $CO_2$ refrigeration systems, since the pressure in $CO_2$ refrigeration systems is higher than for artificial refrigerants and therefore the wear between the crankshaft and the slider block is increased and can cause failure of the compressor. The wear is in particular increased at the contacting surfaces between the crankshaft and the slider block, for example between the first end portion of the crankshaft and the slider block, in particular the contacting surfaces formed between them.

Hence, there is a need in the art for improving the coupling between the crankshaft and the orbiting scroll plate in a compressor.

The above-mentioned need is fulfilled by the crankshaft and/or slider block configuration according to the invention. The above-mentioned need is also fulfilled by a system comprising a crankshaft and a slider block according to the current invention.

A system according to the invention is configured for use in a scroll compressor and comprises a crankshaft and slider block.

The crankshaft defines an axis of rotation and comprises a first end portion. The first end portion may comprise a pin, which extends from the first end portion and is configured for being coupled to the slider block. The axis of rotation may be a longitudinal axis, defined by a body of the crankshaft.

The slider block comprises a recess. The person skilled in the art will appreciate that the recess may also be a bore or a continuous hole. The slider block may have a cylindrical shell surface.

The crankshaft may be configured for applying force from a motor of the compressor to the slider block and thereby to the orbiting scroll plate of the compressor. This is achieved by the first end portion of the crankshaft being configured for being placed at least partially in the recess of the slider block. Thereby, the first end portion and the recess may form a form-fit connection for transferring a force provided by the motor from the crankshaft to the slider block and the orbiting scroll plate.

The first end portion of the crankshaft comprises a first flat contact surface portion and the recess of the slider block comprises a second flat contact surface portion. The first and second contact surface portions face each other when the first end portion is placed at least partially in the recess of the slider block. Thereby, the first and second flat contact surface portions form contacting surfaces. A flat contact surface portion in the sense of the current invention refers to a surface portion, which is flat when looked at in a plane of a cross-section oriented perpendicular to the axis of rotation defined by the crankshaft. In a particular example, the first end portion may have a substantially circular cross-section, wherein a portion of the circular cross-section may be flattened, thereby, forming a cross-section in the form of a "D". In another example, the first end portion may have more than one flat contact surface portions and may for example have a cross-section in the shape of a rectangle. The person skilled in the art will understand, that the flat contact surface portion does not need to be entirely flat. Instead, it would also be possible that the flat contact surface portion is slightly curved or has a structure. As used throughout the description, a surface portion being flat means that the surface portion is able to engage with a corresponding contact surface portion of the other component, i.e. the slider block or the crankshaft.

SUMMARY

According to the current invention, at least one of the first and second flat contact surface portions comprises a slit beneath the at least one flat contact surface portion. The slit reduces the stiffness of the flat contact surface portion. This allows for improving the contact between the first flat contact surface portion and the second flat contact surface portion of the respective other component.

In some preferred embodiments, at least one of the two flat contact surface portions may be curved in a direction parallel to the axis of rotation defined by the crankshaft. The curved surface portion, which is formed this way, may be a convex surface portion.

The slit causes a reduced stiffness of the material in the surface area of the respective flat contact surface portion. Because of the reduced stiffness, the flat contact surface portion can at least partially adjust its shape to the flat contact surface portion of the other component. Preferably, the flat contact surface portion of the other component is slightly curved in a direction perpendicular to the direction in which the contact surface portion looks flat. For example, the flat contact surface portion of the other component may be flat in a cross-section perpendicular to the axis of rotation of the crankshaft and may be curved in a direction parallel to the axis of rotation defined by the crankshaft. This increase reduces the contact stress and the wear and improves the durability and lifetime of the coupling between the crankshaft and the orbiting scroll plate via the slider block.

In preferred embodiments, the slit is oriented perpendicular to the axis of rotation defined by the crankshaft. More preferably, one of the two components has a convex surface portion, which is curved along a direction parallel to the axis of rotation defined by the crankshaft as described before. Having the slit perpendicular to the axis of rotation of the crankshaft and the convex surface portion curved along a direction perpendicular to the direction of the slit improves the adjustment of the flat contact surface portion to the convex surface portion.

Similarly, in some other preferred embodiments, the slit is oriented parallel to the axis of rotation defined by the crankshaft. More preferably, the curved surface portion is curved along a direction perpendicular to the axis of rotation defined by the crankshaft. Having the slit parallel to the axis of rotation defined by the crankshaft and the curved surface portion curved along a direction perpendicular to the direction of the slit improves the adjustment of the flat contact surface portion to the curved surface portion.

In any of these embodiments, the slider block preferably has a cylindrical shell surface.

The above-mentioned need is also overcome by a crankshaft according to the current invention. A crankshaft according to the current invention is configured for use in a scroll compressor. The crankshaft comprises a body, which defines an axis of rotation, and a first end portion. The crankshaft is configured for applying force from a motor to a slider block, which is located in a recess of a scroll plate of the compressor.

According to the current invention, the first end portion comprises a flat contact surface portion and a slit beneath the flat contact surface portion. The slit reduces the stiffness of the flat surfaces. This allows for improving the contact between the flat contact surface portion of the flat contact surface portion and the slider block. As has been described before, a flat contact surface portion in the sense of the current invention refers to a surface portion, which is flat when looked at in a plane of a cross-section oriented perpendicular to the axis of rotation defined by the crankshaft. Thereby, the cross-section of the first end portion of the crankshaft may have a "D" shape.

In some preferred embodiments, the slit is oriented perpendicular to the axis of rotation defined by the body of the crankshaft. This is in particular beneficial if the first end portion of the crankshaft shall be placed in a recess of a slider block, when the recess comprises a curved surface portion and the curved surface is curved along a direction parallel to the axis of rotation.

In some preferred embodiments, the slit is oriented parallel to the axis of rotation defined by the body of the crankshaft. This is in particular beneficial if the first end portion of the crankshaft shall be placed in a recess of a slider block, when the recess comprises a curved surface portion and the curved surface is curved along a direction perpendicular to the axis of rotation.

In some preferred embodiments, the first end portion comprises a protruding element, which extends longitudinally to the axis of rotation from the first end portion of the crankshaft, and an insert, which is attached to the protruding element, and wherein the slit is formed between the protruding element and the insert. This may improve the manufacturing of the crankshaft, because the insert can be added to a conventional crankshaft. At least one of the protruding element and the insert may comprise a recess for forming the slit, when the insert is attached to the protruding element.

The above-mentioned need is also overcome by a slider block according to the current invention. A slider block according to the current invention is configured for use in a scroll compressor and comprises a body, which defines an axis of rotation, and a recess. The body may be a cylindrical body. The cylindrical body may have a top surface and a bottom surface, as well as a cylindrical outer surface. The recess may be located at the top surface or the bottom surface. The recess may extend at least partially into the body of the slider block. In some embodiments, the recess may be a bore or a continuous hole, which extends from the bottom surface to the top surface entirely.

According to the current invention, the slider block comprises a flat contact surface portion and a slit beneath the flat contact surface portion. The flat contact surface portion is an inner surface portion of the recess. The slit reduces the stiffness of the flat surfaces. This allows for improving the contact between the flat contact surface portion of the pin and the slider block. Similar to what has been described before, a flat contact surface portion in the sense of the current invention refers to a surface portion, which is flat when looked at in a plane of a cross-section oriented perpendicular to an axis of rotation defined by the crankshaft, or in case of the slider block the axis of rotation defined by the body of the slider block. Thereby, the recess of the slider block may have a "D" shape.

In some preferred embodiments, the slit is oriented perpendicular to the axis of rotation defined by the body of the slider block. This is in particular beneficial if the slider block is used in combination with a first end portion of a crankshaft, when the first end portion comprises a curved surface portion and the curved surface is curved along a direction parallel to the cylinder axis of the slider block.

In some preferred embodiments, the slit is oriented parallel to the axis of rotation defined by the body of the slider block. This is in particular beneficial if the slider block is used in combination with a first end portion of a crankshaft, when the first end portion comprises a curved surface portion and the curved surface is curved along a direction perpendicular to the cylinder axis of the slider block.

The person skilled in the art will appreciate that any configuration, which comprises a slit in the first end portion of the crankshaft as well as a slit in the slider block will not deviate from the current application, but is also encompassed. Therefore, further slits are possible. For example, it may be possible that a flat contact surface portion of a first end portion of a crankshaft comprises a slit, while also a flat contact surface portion of a slider block comprises a slit.

The following description and the annexed drawings set forth in detail certain illustrative aspects of the system and apparatuses described above. These aspects are indicative, however, of but a few of the various ways in which the principles of various embodiments can be employed and the described embodiments are intended to include all such aspects and their equivalent. In particular it needs to be highlighted that—although the following drawings only show embodiment examples of scroll compressors—the invention may be applied to any type of compressor.

DRAWINGS

In the drawings, like reference characters generally refer to the same parts throughout the different drawings. The drawings are not necessarily to scale, emphasis instead generally being placed upon illustrating the principles of the invention.

In the following description, various embodiments of the invention are described with reference to the following drawings, in which:

FIG. 1 shows a cross-sectional view of an embodiment of a scroll compressor according to the current invention.

Figure 2A:
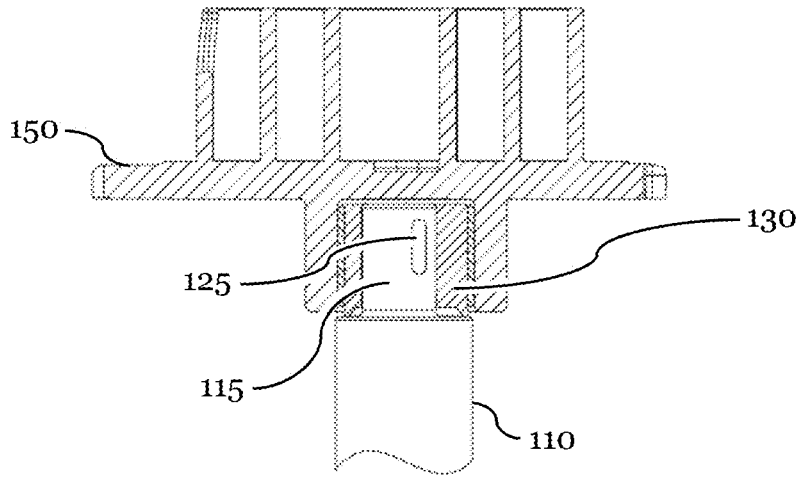
Figure 2B:
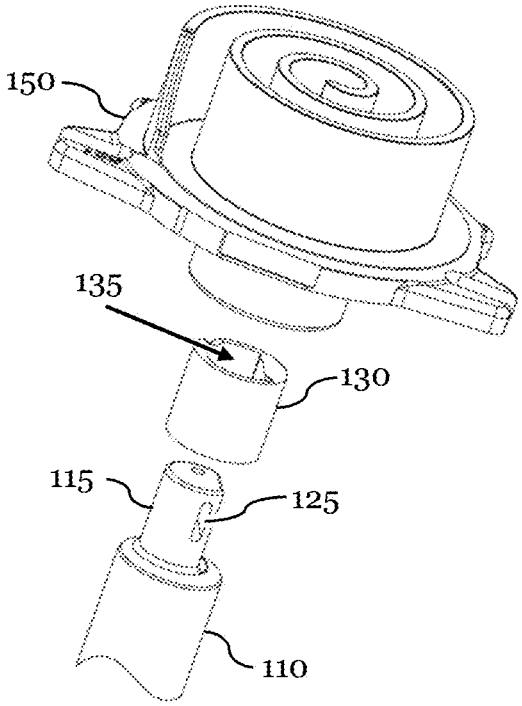

FIG. 2*a*, 2*b* show detail images of a crankshaft and slider block according to the current invention (a) in an assembled state with an orbiting scroll plate and (b) in an exploded view.

Figure 3A:
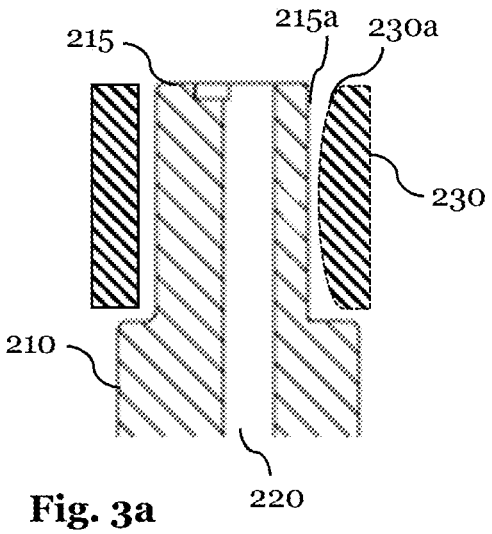
Fig. 3a Prior Art
Figure 3B:
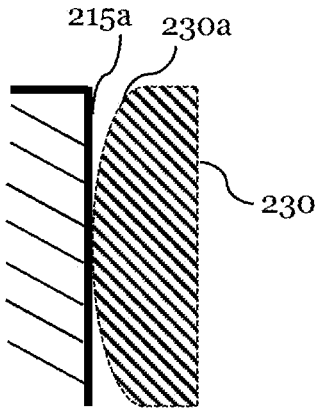
Fig. 3b Prior Art

FIG. 3*a*, 3*b* show detail images of (a) a first end portion of a crankshaft and a slider block according to the state of the art and (b) the engagement of the flat contact surface portion of the first end portion of the crankshaft and a flat contact surface portion of the slider block, which is curved in a direction perpendicular to the axis of rotation defined by the crankshaft.

Figure 4A:
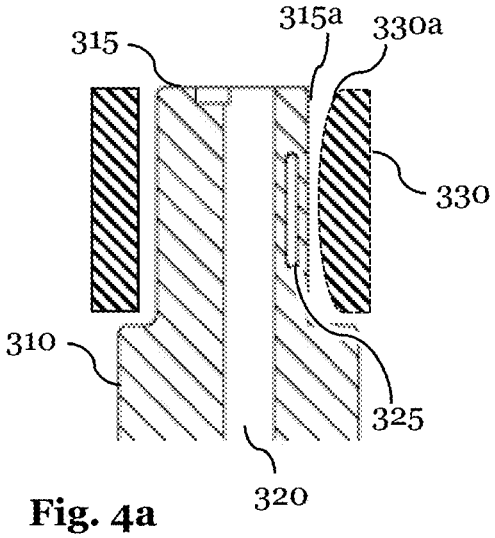
Figure 4B:
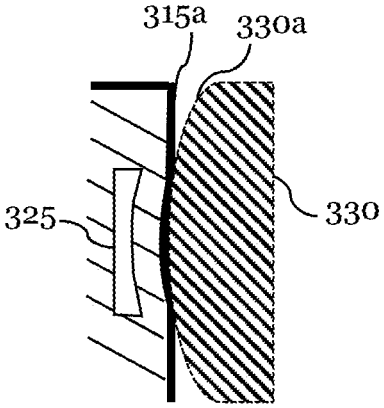

FIG. 4*a*, 4*b* show detail images of (a) a first end portion of a crankshaft and a slider block according to the current invention and (b) the engagement of the flat contact surface portion of the first end portion of the crankshaft and a flat contact surface portion of the slider block, which is curved in a direction perpendicular to the axis of rotation defined by the crankshaft.

FIGS. 5*a* to 5*f* show embodiment examples of first end portions of a crankshaft according to the current invention, wherein the first end portion comprises a flat contact surface portion and a slit, which is oriented perpendicular to the axis of rotation defined by the body of the crankshaft.

Figure 6:
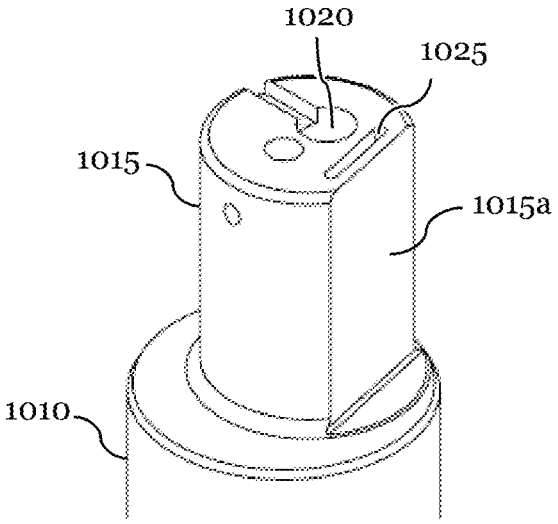

FIG. 6 shows an embodiment example of a first end portion of a crankshaft according to the current invention, wherein the first end portion comprises a flat contact surface portion and a slit, which is oriented parallel to the axis of rotation defined by the body of the crankshaft.

Figure 7A:
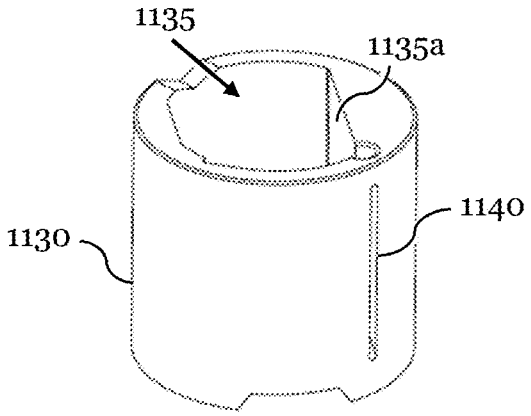
Figure 7B:
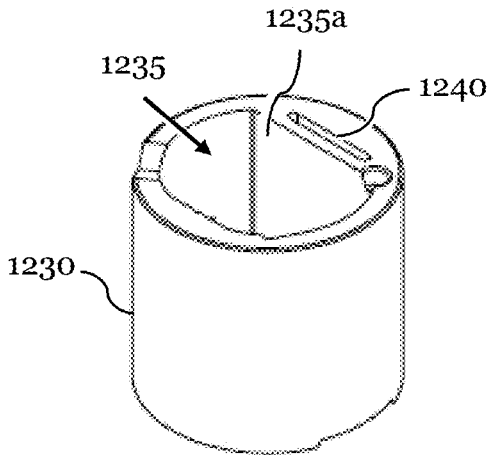

FIG. 7*a*, 7*b* show embodiment examples of slider blocks according to the current invention, wherein the slider block comprises a flat contact surface portion and a slit, which is (a) perpendicular to the axis of rotation defined by a crankshaft and (b) longitudinal to said axis.

DETAILED DESCRIPTION

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

FIG. 1 shows a cross-sectional view of an embodiment of a scroll compressor according to the current invention. The compressor 100 comprises a case 190 and a suction port 160 for receiving refrigerant. The compressor 100 compresses the refrigerant in a compression chamber. Since compressor 100 is a scroll compressor, the compression chamber is formed by a scroll set comprising a stationary scroll plate 155 and an orbiting scroll plate 150. After compression, the refrigerant will be discharged from a discharge port 170. Moving parts inside the compressor 100 are lubricated by a lubricant, which is provided by a lubricant sump 180.

The compressor 100 comprises a motor 105. The motor 105 is used to drive the compressor by agitating the compression chamber, in particular by causing an orbiting motion of the orbiting scroll plate 150. In order to achieve this, the compressor comprises a crankshaft 110. A portion of the crankshaft 110 is connected to the motor 105.

During operation, the motor 105 causes a rotational motion of the crankshaft 110 around an axis of rotation. The rotational motion is transferred from the crankshaft 110 to an orbiting motion of the orbiting scroll plate 150. The crankshaft 110 comprises a first end portion with a pin 115, which extends longitudinally to the axis of rotation from an end portion of the crankshaft 110. A center of the pin 115 may be offset to the axis of rotation.

The pin 115 engages a slider block 130. The slider block 130 has a cylindrical body and comprises a recess in form of a bore, wherein a center of the bore is offset to the axis of rotation. The pin 115 at least partially extends into the bore. The slider block 130 rotates around the axis of rotation of the crankshaft and because of the offset, the slider block 130 also orbits around the axis of rotation at the same time. The slider block 130 is located in a recess of the orbiting scroll plate 150. Said recess comprises boundaries. The boundaries form an approximately cylindrical recess, which has a diameter slightly larger than the diameter of the cylindrical slider block. Because of the cylindrical body, the slider block 130 can freely rotate inside the recess of the orbiting scroll plate 150, without locking with the boundaries and therefore without transferring any rotational motion to the orbiting scroll plate 150. However, the orbiting motion of the slider block 130 causes a force against the boundaries of the recess and thereby cause an orbiting motion of the orbiting scroll plate 150, but without any rotation.

The pin 115, which engages the slider block 130, comprises a slit 125, which reduces the stiffness of a surface portion of the pin 115, wherein the surface portion is in contact with the slider block 130. This will be shown in more detail further below with reference to FIGS. 3 and 4.

FIGS. 2*a* and 2*b* show detail images of a crankshaft and slider block according to the current invention (a) in an assembled state with an orbiting scroll plate and (b) in an exploded view.

FIG. 2*a* shows the pin 115 of the first end portion of the crankshaft 110, the slider block 130 and the orbiting scroll plate 150 in more detail in an assembled state. In a recess on the backside of the orbiting scroll plate 150, the slider block 130 is located and the pin 115 of the first end portion of the crankshaft 110 is located in a recess or opening 135 of the slider block 130. When the crankshaft 110 rotates, the pin 115 rotates as well and the motion is transferred to the slider block 130. Since the slider block 130 usually has a cylindrical outer surface, as can be seen in the exploded view in FIG. 2*b*, the slider block 130 can rotate within the recess of the orbiting scroll plate 150, without transferring the rotational motion to the orbiting scroll plate 150. Since the center of the bore of the slider block 130 is offset to the rotational axis of the crankshaft 110 when the slider block 130 and the pin 115 are assembled, the slider block 130 also performs an orbiting motion around the rotation axis, which is transferred to the orbiting scroll plate.

FIGS. 3*a* and 3*b* are detail images of (a) a first end portion of a crankshaft and a slider block according to the current invention and (b) the engagement of the flat contact surface portions of the first end portion of the crankshaft and a flat contact surface portion of the slider block, which is curved in a direction perpendicular to the axis of rotation defined by the crankshaft.

In FIG. 3*a*, a crankshaft 210 and a slider block 230 according to the state of art are shown. The crankshaft 210 comprises a first end portion with a pin 215 with a flat contact surface portion 215*a*. Also, the crankshaft 210 comprises a lubricant supply passage 220, which is used for providing lubricant from a lubricant sump to the upper crankshaft portion, the slider block 230, and the orbiting scroll plate. The lubricant supply passage 220 is an optional element, but it improves the lubricant supply and reduces the wear between the moving elements.

The slider block 230 comprises a recess in form of a bore and a flat contact surface portion 230*a*, which is curved in a direction perpendicular to the axis of rotation defined by the crankshaft, at an inner portion of the bore. As has been described earlier, the surface portion 230*a* is still flat in the sense that the surface portion is flat when viewed in a cross-section perpendicular to the axis of rotation defined by the crankshaft 210. When the pin 215 is placed at least partially within the bore of the slider block 230, the flat contact surface portion 215*a* of the pin 215 and the surface portion 230*a* of the slider block 230 engage each other and form contacting surfaces. Preferably, the surface 230*a* may be curved in a convex manner as shown in FIG. 3*a*.

When the crankshaft 210 is rotating, the pin 215 is pushed against the surface portion 230*a* of the slider block 230 as shown in FIG. 3*b*. Thereby, curving the surface 230*a* is used to compensate manufacturing imperfections and create a fitting contact with the flat contact surface portion 215*a* of the pin 215.

However, curving the surface portion 230*a* reduces the contact area between the contacting surfaces, as can be seen in FIG. 3*b*, which shows a detail image of the flat contact surface portion 215*a* and the surface portion 230*a* of slider block 230. This small contact area between the contacting surfaces increases the wear between the crankshaft 210 and the slider block 230, thereby reducing the durability and the lifetime of the compressor.

FIGS. 4*a* and 4*b* show detail images of (a) a first end portion of a crankshaft and a slider block according to the current invention and (b) the engagement of the flat contact surface portion of the first end portion of the crankshaft and a flat contact surface portion of the slider block, which is curved in a direction perpendicular to the axis of rotation defined by the crankshaft.

In FIG. 4*a*, crankshaft 310 comprises a first end portion with a pin 315 with a flat contact surface portion 315*a*. Further, the crankshaft comprises a lubricant supply passage 320, which is again optional. According to the current invention, the pin 315 comprises a slit 325 beneath the flat contact surface portion 315*a*. The slit 325 reduces the stiffness of the material locally, in particular the stiffness of the material of the crankshaft pin between the flat contact surface portion 315*a* and the slit 325, because the material can be bend into the slit 325 upon pressure against the flat contact surface portion 315*a*.

FIG. 4*b* shows a detail image of the contact between the flat contact surface portion 315*a* and the surface portion 330*a* of the slider block 330, which is curved in a direction perpendicular to the axis of rotation defined by the crankshaft. Upon pressure, the flat contact surface portion 315*a* of the pin 315 is pushed against the surface portion 330*a* of the slider block 330. The pressure at the contacting area and the reduced stiffness of the material between the flat contact surface portion 315*a* and the slit 325 cause a bending of the flat contact surface portion 315*a* into the slit 325. This increases the contacting area between the bended flat contact surface portion 315*a* and the surface portion 330*a* of the slider block 330*a*. An increased contact area reduces the wear and increases the durability and lifetime of the compressor.

FIGS. 5*a* to 5*f* show embodiment examples of first end portions of a crankshaft according to the current invention, wherein the first end portion comprises a slit, which is oriented perpendicular to an axis of rotation defined by the body of the crankshaft.

Figure 5A:
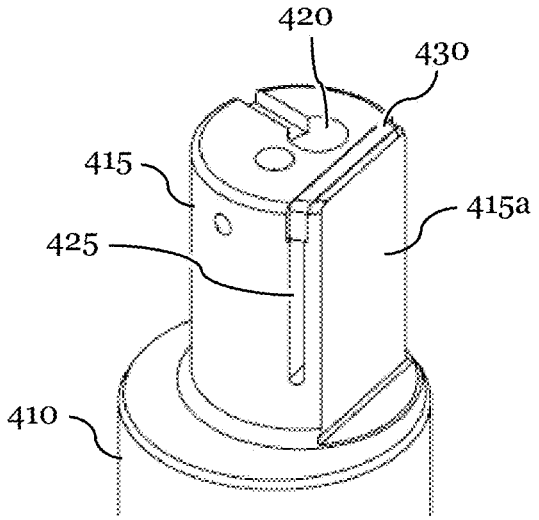

In the embodiment example depicted in FIG. 5*a*, a crankshaft 410 with a first end portion and a pin 415 is shown. The crankshaft 410 comprises an optional lubricant supply passage 420. The pin 415 comprises a flat contact surface portion 415*a*. A slit 425 is created by cutting a recess into the pin 415 from the top of the crankshaft pin 415. Afterwards, the recess is closed at the top with an insert 430.

Figure 5B:
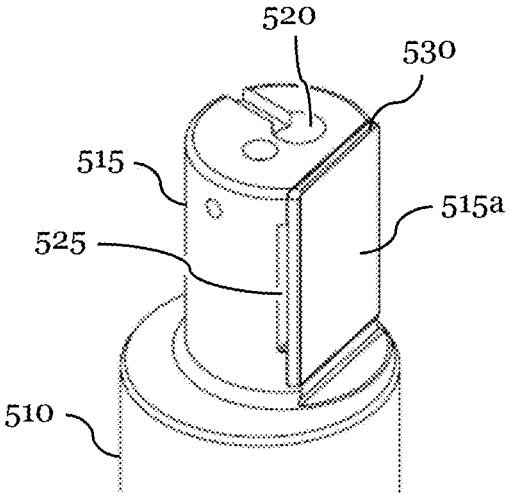

In the embodiment example depicted in FIG. 5*b*, a crankshaft 510 with a pin 515 is shown. The crankshaft 510 comprises an optional lubricant supply passage 520. The pin 515 comprises a flat contact surface portion 515*a*. A slit 525 is created by forming a recess in the pin at the location of the slit 525 and placing an insert 530 on top of the slit 525. The insert 530 comprises the flat contact surface portion 515*a*.

Figure 5C:
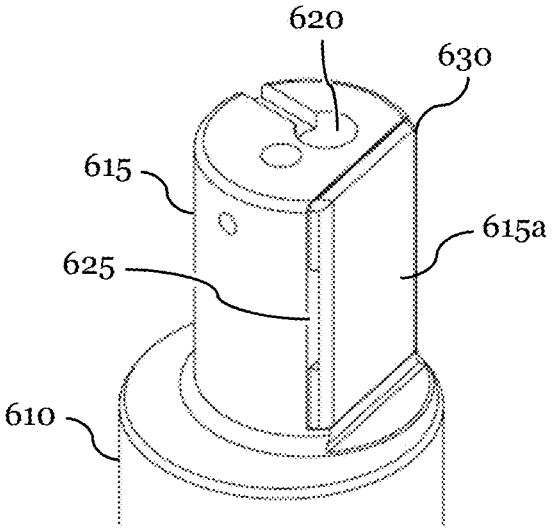

In the embodiment example depicted in FIG. 5*c*, a crankshaft 610 with a first end portion and a pin 615 is shown. The crankshaft 610 comprises an optional lubricant supply passage 620. The pin 615 comprises a flat contact surface portion 615*a*. A slit 625 is created by placing an insert 630 on a side of the pin 615, wherein the insert comprises a recess on its backside, which forms the slit 625 and a flat contact surface portion 615*a* on its frontside.

The person skilled in the art will appreciate that the slit may also be formed by a recess in the pin of the crankshaft in combination with a recess on the backside of an insert, which is placed above the recess of the pin.

Figure 5D:
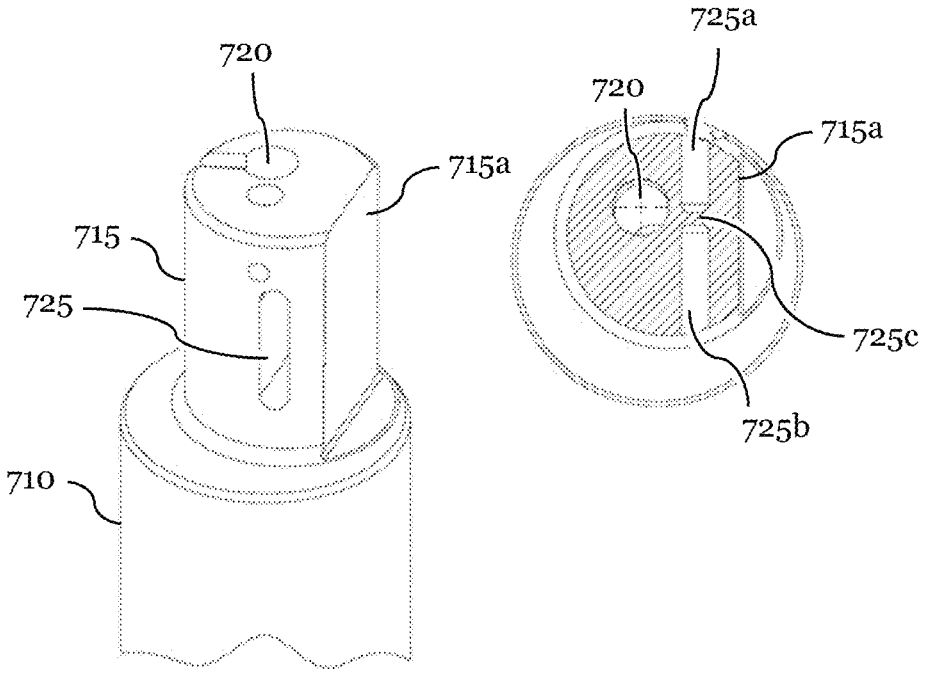

In the embodiment example depicted in FIG. 5*d*, a crankshaft 710 with a first end portion and a pin 715 is shown on the left hand side in a perspective view and on the right hand side in a top view. The crankshaft 710 comprises an optional lubricant supply passage 720. The pin 715 comprises a flat contact surface portion 715*a*. The slit portion 725 is formed by two slits 725*a*, 725*b*, which do not extend through the entire thickness of the pin. Instead, a bar 725*c* separate the two slits 725*a*, 725*b*. Such a configuration avoids that the slit reduces the stiffness too much and provides more stability than, for example, the embodiment depicted in FIG. 5*a*.

Figure 5E:
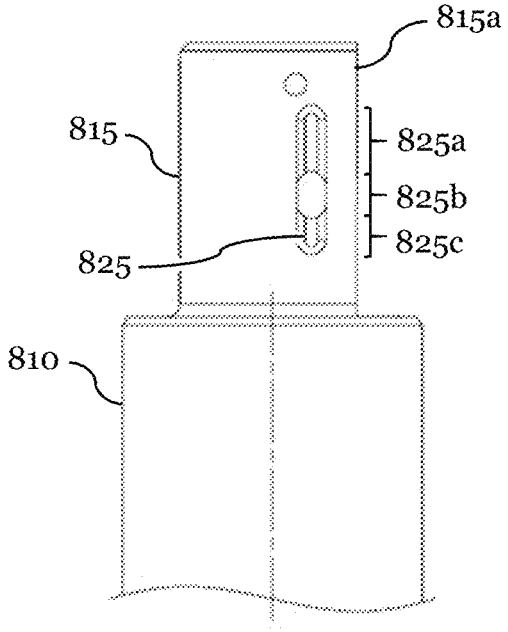

The embodiment example depicted in FIG. 5*e* is similar to the embodiment example depicted in FIG. 5*d*, however, the bar does not separate the two slits over the entire height of the slit, wherein the height refers to the extend of the slit in the direction parallel to the rotation axis of the crankshaft. For example, as is depicted in FIG. 5*d*, the bar separates the slits in the areas 825*a* and 825*c*, but not in area 825*b*. Such a configuration may be used in a situation where a bar would create too much stiffness, but a slit extending through the entire thickness of the pin would create too much instability.

Figure 5F:
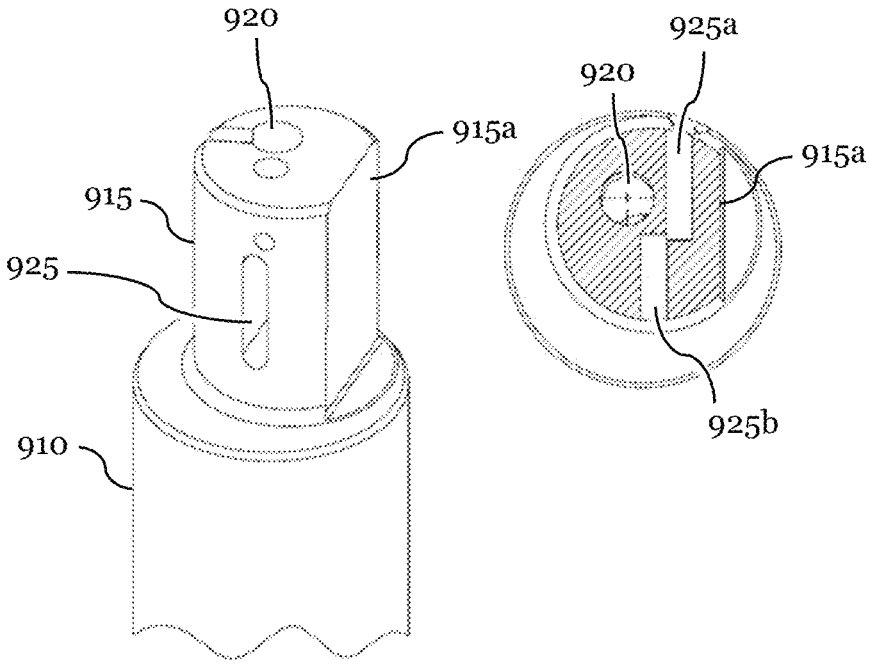

In the embodiment example depicted in FIG. 5*f*, a crankshaft 910 with a first end portion and a pin 915 is shown on the left hand side in a perspective view and on the right hand side in a top view. The crankshaft 910 comprises an optional lubricant supply passage 920. The pin 915 comprises a flat contact surface portion 915*a*. The slit portion 925 is formed by two slits 925*a*, 925*b*, which do not extend through the entire thickness of the pin. In contrast to the embodiment example depicted in FIG. 5*d*, the two slits 925*a*, 925*b* are offset from one another.

In the embodiment examples of FIGS. 5*a* to 5*f*, the slits 425, 525, 625, 725, 825, 925 are oriented perpendicular to the axis of rotation of the respective crankshaft.

FIG. 6 shows an embodiment example of a first end portion of a crankshaft according to the current invention, wherein the first end portion comprises a slit, which is oriented parallel to an axis of rotation defined by the body of the crankshaft.

In the embodiment example depicted in FIG. 6, a crankshaft 1010 with a first end portion and a pin 1015 is shown. The crankshaft 1010 comprises an optional lubricant supply passage 1020. The pin 1015 comprises a flat contact surface portion 1015*a*. A slit 1025 is created by cutting the slit into the pin from the top of the pin 1015.

In the embodiment example of FIG. 6, the slit 1025 extends parallel to the axis of rotation of the crankshaft 1010.

FIGS. 7*a* and 7*b* show embodiment examples of slider blocks according to the current invention, wherein the slider block comprises a slit, which is (a) perpendicular to the axis of rotation defined by a crankshaft and (b) longitudinal to said axis.

FIG. 7*a* shows an embodiment example of a slider block 1130. The slider block 1130 has a cylindrical body with a recess in form of a bore 1135. The bore 1135 extends from the top of the cylindrical body to the bottom. In some examples, the bore does not need to extend along the entire height of the cylindrical body. The bore 1130 comprises a flat contact surface portion 1135*a* for locking with a corresponding surface of a crankshaft pin, when the pin is placed at least partially inside the bore 1135. Beneath the flat contact surface portion 1135*a*, the slider block 1130 comprises a slit 1140. The slit 1140 is oriented perpendicular to the cylinder axis of the cylindrical body of the slider block 1130.

FIG. 7*b* shows an embodiment example of a slider block 1230. The slider block 1230 has a cylindrical body with a bore 1235. The bore 1235 extends from the top of the cylindrical body to the bottom. In some examples, the bore does not need to extend along the entire height of the cylindrical body. The bore 1230 comprises a flat contact surface portion 1235*a* for locking with a corresponding surface of a crankshaft pin, when the pin is placed at least partially inside the bore 1235. Beneath the flat contact surface portion 1235*a*, the slider block 1230 comprises a slit 1240. The slit 1240 is oriented parallel to the cylinder axis of the cylindrical body of the slider block 1230.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the scope of the appended claims.

What is claimed is:

1. A system for use in a scroll compressor, the system comprising:

a crankshaft with a first end portion, wherein the crankshaft defines an axis of rotation;

a slider block having a recess, wherein the first end portion of the crankshaft and the recess in the slider block are configured for connecting the slider block to the first end portion;

wherein the first end portion of the crankshaft comprises a first flat contact surface portion and the recess of the slider block comprises a second flat contact surface portion, wherein the first and second contact surface portions face each other when the first end portion of the crankshaft is connected to the slider block, wherein at least one of the flat contact surface portions comprises a slit beneath the at least one flat contact surface portion, wherein the slit is configured to reduce a stiffness of the at least one of the flat contact surface portions, wherein the slit is oriented perpendicular to the axis of rotation defined by the crankshaft, and wherein the other flat contact surface portion is curved in a direction parallel to the axis of rotation defined by the crankshaft.

2. The system according to claim 1, wherein the flat contact surface portions are defined by a portion of the surface being flat in a plane of a cross-section oriented perpendicular to the axis of rotation defined by the crankshaft.

3. The system according to claim 1, wherein the other flat contact surface portion, which is curved, has a convex surface portion.

4. The system according to claim 1, wherein the outer surface of the slider block is a cylindrical shell surface.

5. A crankshaft for use in a scroll compressor, the crankshaft comprising:

a body, which defines an axis of rotation; and a first end portion, wherein the crankshaft is configured for applying force from a motor to a slider block, which is located in a recess of a scroll plate of the compressor, wherein the first end portion comprises a flat contact surface portion and a slit beneath the flat contact surface portion, wherein the slit is configured to reduce a stiffness of the flat contact surface portion, and wherein the slit is oriented perpendicular to the axis of rotation defined by the crankshaft.

6. The crankshaft according to claim 5, wherein the first end portion comprises a protruding element, which extends longitudinally to the axis of rotation from the first end portion of the crankshaft, and an insert, which is attached to the first end portion, and wherein the slit is formed between the first end portion and the insert.

7. The crankshaft according to claim 6, wherein at least the protruding element or the insert comprises a recess for forming the slit, when the insert is attached to the protruding element.

8. A slider block for use in a scroll compressor, the slider block comprising:

a body, which defines an axis of rotation; and a recess, wherein the recess is configured for being connected to a first end portion of a crankshaft;

wherein the slider block comprises a flat contact surface portion and a slit beneath the flat contact surface portion, the slit is configured to reduce a stiffness of the flat contact surface portion, and wherein the slit is oriented perpendicular to the axis of rotation.

* * * * *